United States Patent [19]

Wilson

[11] 4,245,574

[45] Jan. 20, 1981

[54] TUFTED FABRIC AND METHOD AND APPARATUS FOR MAKING SAME

[75] Inventor: Bobby L. Wilson, Ringgold, Ga.

[73] Assignee: Spencer Wright Industries, Inc., Chattanooga, Tenn.

[21] Appl. No.: 48,611

[22] Filed: Jun. 13, 1979

[51] Int. Cl.[3] ..... D05C 15/00

[52] U.S. Cl. ..... 112/79 R

[58] Field of Search ..... 112/79 R, 79 A

[56] References Cited

U.S. PATENT DOCUMENTS

| | | | |
|---|---|---|---|
| 3,075,482 | 1/1963 | Card | 112/79 A |
| 3,084,645 | 4/1963 | Card | 112/79 R |
| 3,187,699 | 6/1965 | Bryant et al. | 112/79 R |
| 3,633,523 | 1/1972 | Card | 112/79 A |
| 3,919,953 | 11/1975 | Card et al. | 112/79 R |
| 4,155,319 | 3/1979 | Short | 112/79 R |

*Primary Examiner*—Ronald Feldbaum

*Attorney, Agent, or Firm*—Alan Ruderman

[57] ABSTRACT

A tufted pile fabric having two different levels of cut pile in alternate adjacent rows and a lower level uncut loop pile selectively disposed in each row in place of the cut pile, and a tufting machine and method for producing the fabric. The machine has a needle bar with adjacent needles alternately penetrating a backing fabric to two different depths, and co-act with hooks set at corresponding levels. The hooks all have spring clips which hold loops on the hooks to be cut unless the yarn is backdrawn sufficiently to release the clip and allow the loop to be released. A yarn feed mechanism having chain driven notched slats of different depths with a shiftable yarn guiding finger directs yarn for each needle into the desired notch to control the amount of yarn fed to each needle and thus the patterned array.

7 Claims, 6 Drawing Figures

TUFTED FABRIC AND METHOD AND APPARATUS FOR MAKING SAME

BACKGROUND OF THE INVENTION

This invention relates to tufting machines and tufted fabrics and more particularly to a method and apparatus for forming a new fabric having in alternate rows of stitching selective cut pile and loop pile wherein the cut pile in alternate rows are of different pile height and all the loop pile is of a third and lower pile height.

In the art of tufting, a plurality of yarn carrying needles are reciprocably driven through a backing fabric fed through the machine to form loops which are seized by respective oscillating loopers or hooks on the opposite side of the backing. The loopers may point in the direction of feed of the backing and the seized loops shed on the return movement of the loopers to form a loop pile, or the loopers may point in the direction opposite to the direction in which the fabric is being fed, and cooperate with respective oscillating knives to cut the loops at the closed end of the looper to form cut pile. A major advance in the tufting art occurred when, as disclosed in U.S. Pat. Nos. 2,876,441 and 2,966,866, a pattern attachment which fed yarn to the needles at two different speeds selectively was added to a loop pile tufting machine. The slower speed was such that the yarn fed thereby could not accommodate the yarn requirements of the needles. The needle thus drew back or robbed back yarn from the preceding stitch to form a loop. This allowed production of patterns having high loops and low loops, the low loops being created by the backrobbing process.

The next major advance occurred when, as disclosed in U.S. Pat. No. 3,084,645, a spring clip was added to a looper pointing in the direction in which a cut pile looper points, i.e., opposite the direction of fabric feed, and used in combination with a backrobbing yarn feed pattern attachment. The looper acted together with a knife and when sufficient yarn was fed to the needles the loop remained on the looper and moved toward the closed end to be cut by the knife. However, when the amount of yarn fed was insufficient, the needle pulled yarn from the preceding loop to force the spring clip away from the looper and allowed the loop to slip off. This gave the stylist the ability to produce high cut pile and low loop pile selectively in the same row of stitching, i.e., by the same needle.

Many advances have occurred in the tufting art since that time. Additional patterning effects have been created by laterally shifting the needles in steps according to a pattern prior to insertion into the backing which, when using different yarns threaded through alternate needles, can produce various patterning affects. In U.S. Pat. No. 3,908,570 two needle bars are independently shifted laterally in this manner. Two different levels of cut pile fabric has been patterned using the mechanism disclosed in U.S. Pat. No. 3,138,126 and three level cut pile has been produced by the mechanism disclosed in U.S. Pat. No. 3,075,482. U.S. Pat. No. 3,919.953 discloses means for producing alternate rows of even level cut pile and loop pile, and U.S. Pat. No. 4,134,347 discloses apparatus and means for producing loop pile and cut pile in the same row of substantially the same pile height. From this it should be apparent that the broadloom carpet stylist is constantly seeking new patterning ability and that great effort is exerted in the industry toward this end.

SUMMARY OF THE INVENTION

It has now been determined that enhanced pattern effects are obtainable by selectively forming high pile height cut pile and low pile height loop pile by a first needle in a first row and selectively forming a low pile height cut pile and low pile height loop pile by an adjacent needle in an adjacent row wherein the loop pile in the rows are of the same pile height and lower than the low level cut pile. In other words a fabric having two different levels of cut pile in alternate adjacent rows and with each row selectively having loop pile of a shorter pile height. By proper selection of the gauge between needles, and by selectively threading the needles with yarns of selective colors, exceptionally pleasing patterns have been produced. For example, the low level loop pile can be selected when a particular color is to be hidden by the adjacent longer cut pile of different color thus simulating patterns created by controlled needle machines.

The method of producing the fabric utilizes a tufting machine in which adjacent needles are inserted through the backing fabric to different extents to cooperate with respective loopers alternately spaced at different levels from the backing fabric. The yarns fed to the needles are controlled by a pattern control that can selectively feed yarn at two different rates to every other needle, and can selectively feed yarn at the slower of the two rates and at a third rate intermediate the first and second rates to the alternate needles.

The machine of the present invention has a first set of needles for penetrating the backing fabric to a first depth, and a second set of needles for penetrating the backing fabric to a second and lower depth. A first set of hooks or loopers cooperate with the first set of needles and a second set of hooks or loopers at a lower position cooperate with the second set of needles. Each hook includes a spring clip and a respective knife. A yarn feed attachment capable of selectively feeding yarn at three rates, a high and a low feed rate to the first set of needles and an intermediate rate and the low rate to the second set of needles, feed the yarn to the needles in accordance with a pattern. When the low feed rate is selected the needle backrobs yarn from the preceding stitch to pull the loop past the clip and off the hook without being cut. The other two feed rates allow the loops to stay on the hooks and be cut by the knives.

Consequently, it is a primary object of the present invention to provide a tufted pile fabric having cut pile of two different levels in adjacent rows and selective loop pile in each row of a lower level than the lower of the cut pile.

It is another object of this invention to provide a method for producing this fabric.

It is a further object of this invention to provide a tufting machine in which adjacent needles penetrate a base fabric to different extents to cooperate with respective loopers having spring clips positioned at different levels and a yarn feed attachment for feeding yarn at two different rates to alternate needles and a third and slower rate to each of the needles selectively.

BRIEF DESCRIPTION OF THE DRAWINGS

The particular features and advantages of the invention as well as other objects will become apparent from the following description taken in connection with the accompanying drawings, in which.

Figure 1:
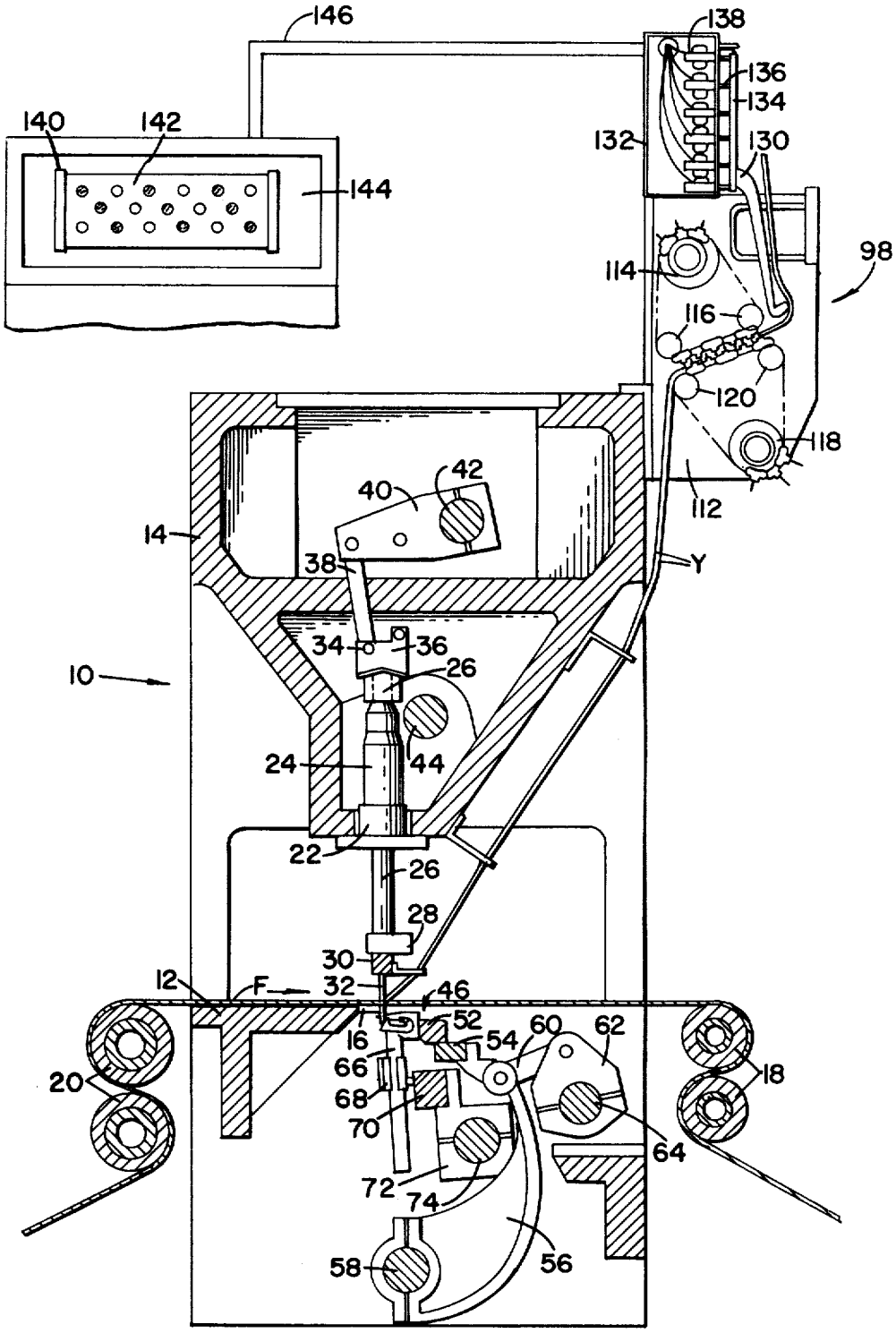
FIG. 1 is a vertical sectional view transversely through a tufting machine constructed in accordance with the principles of the present invention.
Figure 2:
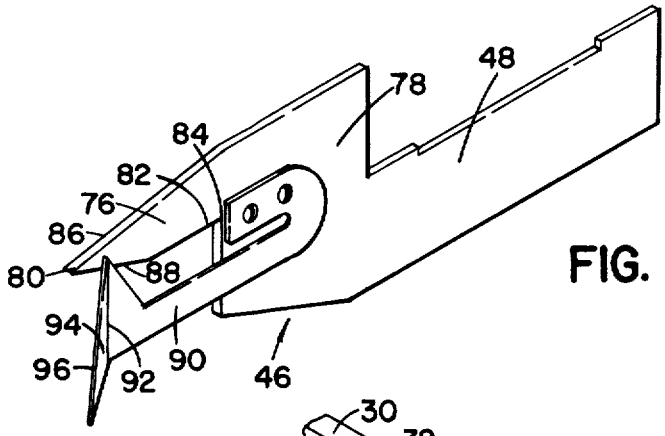
FIG. 2 is a perspective view of one of the hooks of the machine of FIG. 1.

Referring now to the drawings, there is illustrated in FIG. 1 a tufting machine 10 of the preferred form having a frame comprising a bed 12 and a head 14 disposed above the bed. The bed 12 includes a bed plate 16 across which a backing fabric F is adapted to be fed by a pair of feed rolls 18 and take-off rolls 20.

Mounted in the head 14 are a plurality of collars 22 only one of which is shown, for supporting a respective sleeve 24. Riciprocably mounted within each sleeve is a push rod 26, to the lower end of which a needle bar carrier 28 is attached and which in turn supports a needle bar 30 which carries a multiplicity of needles 32 and 33. The upper end of the push rod 26 is connected by a wrist pin 34 to a connecting member 36 which in turn is connected by a link 38 to a rock arm 40 on a rock shaft 42. Rocking motion is supplied to the shaft 42 by conventional means such as from a cam shaft 44 and is fully described in U.S. Pat. No. 2,977,905, which should be referred to if a further description is desired. Briefly, however, a circular cam is eccentrically fixed to the shaft 44 and drives a lever fixed to the shaft 42 through a connecting rod. Rotational motion of the shaft 44 is thus converted into rocking motion at shaft 42 to reciprocate the push rods 26, the needle bar 30 and the needles 32, 33.

Mounted in the bed 12 for cooperation with the needles to seize loops of yarn presented thereby are a plurality of loopers or hooks generally indicated at 46 which point in the direction opposite to that to which the fabric is fed and to which further reference will be made. The hooks have planar mounting portions 48 that are mounted in slots 50 in hook bars 52 carried by a mounting bar 54 secured to the upper end of a rocker arm 56. Conventionally the rocker arm 56 may be oscillated by a rock shaft 58 clamped at the lower end of the arm and journalled in the bed. Pivotably connected to the upper portion of the rocker arm is one end of a connecting link 60 having its other end pivotably connected between forked arms of a jack shaft rocker arm 62 which in turn is clamped to a jack shaft 64 oscillated by conventional drive means from the shaft 44 in timed relationship with the reciprocation of the needles.

A plurality of knives 66 respectively cooperate with the hooks to cut selected loops as hereinafter described to form cut pile. The knives are mounted in knife blocks 68 secured to a knife bar 70 which in turn is secured to a knife shaft rocker arm 72 clamped to a knife shaft 74. Oscillatory movement is imparted to the knife shaft 74 to conventionally drive the knives into engagement with one side of the repective hooks to provide a scissors-like cutting action.

The hooks 46 are of the cut/loop type forming the subject matter of U.S. Pat. No. 3,084,645 and comprise a body portion having a blade 76 and a shank 78 which includes the mounting portion 48, and a bill 80 at the free end of the blade. The closed end of the blade extends to the shank 78 and has a bottom edge 82 extending from a throat 84 formed between the blade and the shank. The top portion 86 of the blade and the bottom portion 88 thereof slope away from the shank to form the bill 80.

Secured by conventional means to the opposite side of the shank from which the knife acts is a resilient finger or spring clip 90. The clip extends below the blade 76 and bends in a slight arc away from the plane of the hook body at the shank. The clip bends back at a crease 92 in a delta shaped head portion 94 to engage the bill 80 slightly rearwardly of its free end. The forward facing edge 96 of the head portion 94 flares outwardly away from the bill 80 and the crease 92 at such an angle to engage and guide the respective needle 32, 33 between the bill 80 and the clip 90 when the hook moves to seize a loop of yarn so the hook bill can pass between the needle and one leg of the yarn. In this manner a loop is seized by the hook and stays on to be cut by the respective knife 66 unless the loop is backdrawn with sufficient tension to force the crease 92 of the clip 90 to separate from the bill and allow the loop to be pulled off the hook.

Figure 3:
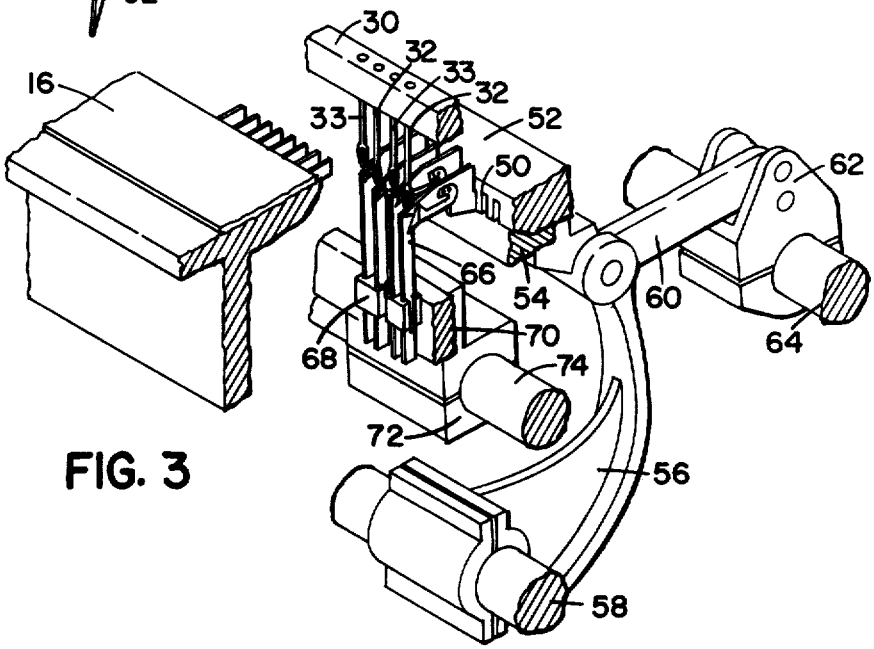
FIG. 3 is a perspective view of the stitching instrumentalities of the machine of FIG. 1 according to one embodiment.
Figure 4:
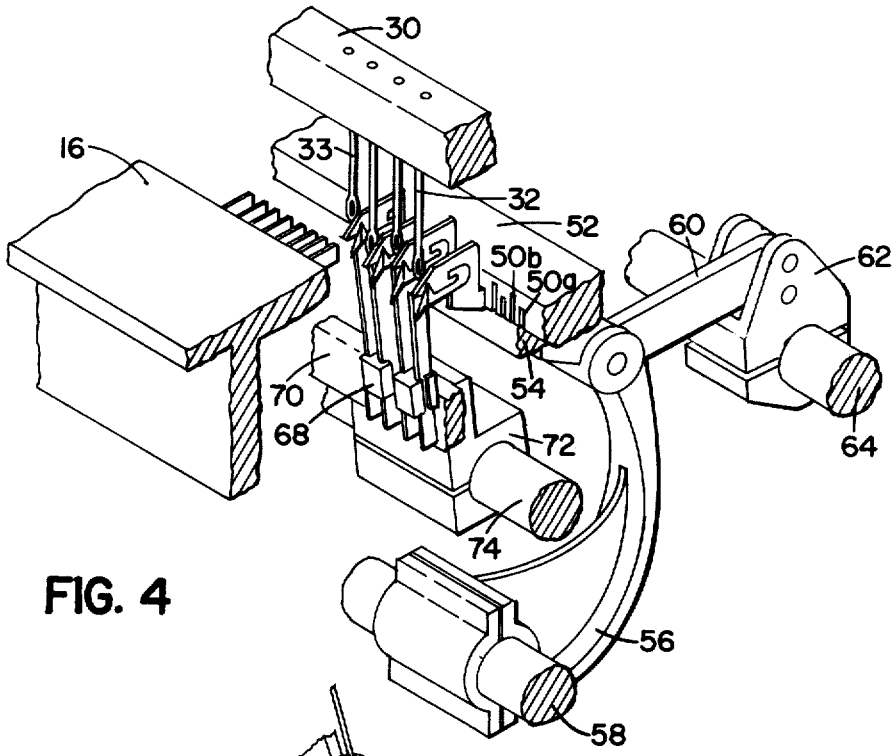
FIG. 4 is a view similar to FIG. 3 but illustrating another embodiment.

In accordance with the present invention the needles 32 penetrate to a lower level than the adjacent needles 33. The preferred mode of accomplishing this is to set the needles 32 in the common needle bar lower than the needles 33. Other more complicated methods are easily foreseen. Since the hooks cooperate with the needles to seize loops, the hooks 46 cooperating with the needles 32 have their blade portions 76 and bills 80 at a lower level than those of the hooks cooperating with the needles 33. One manner of accomplishing this, as illustrated in FIG. 3, is to provide two sets of hooks, those cooperating with the needles 32 having shorter shank portions 78 so that the blades 76 are spaced closer to the mounting portions 48 than those of the hooks cooperating with the needles 33. Thus, all of the hook receiving slots 50 may be cut in the hook bar at the same depth. FIG. 4 illustrates a modification in which all of the hooks are identical but the slots are cut to different depths. Thus, slots **50*a* receive the mounting portions of the hooks that cooperate with the needles 32 while slots 50*b* are cut deeper in the direction toward the needles for receiving the hooks that cooperate with the needles 33. In either event the difference in level between the needles 32 and the needles 33**, and their associated hooks, is substantially the difference between the cut pile levels desired in the adjacent rows of fabric produced.

To obtain the desired patterning effects, yarn Y must be fed to the needles 32 at two different rates, a high rate, to meet the yarn requirements of the system comprising the needle 32 and its respective hook 46 and a low rate inadequate to meet the systems requirement so that the preceding loop will be backdrawn with sufficient force to allow the clip 90 to move and open the hook to allow its withdrawal. Similarly, yarn Y must be fed to the needles 33 at a moderate rate, less than that of the high rate supplied to the needles 32, and a low rate equal to the low rate of the yarn fed to the needles 32. In this manner the rows made by the needles 32 can be selectively high cut pile or low uncut pile, and the alternate rows made by the needles 33 are selectively a low cut pile than the cut pile made by the needles 32 and a low uncut loop pile equal in height to the uncut loop pile made by the needles 32.

Figure 5:
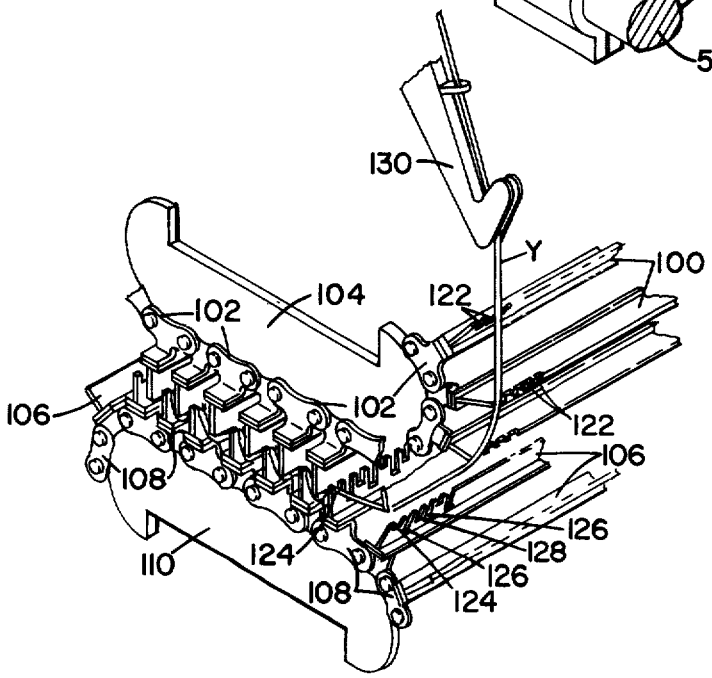
FIG. 5 is a fragmentary perspective view of one of the yarn feed members and a movable guide of the yarn feed attachment in FIG. 1.

The preferred means for obtaining the desired yarn feed rates comprises a yarn feed mechanism generally indicated at 98 in FIG. 1 and more clearly illustrated in FIG. 5. The mechanism comprises a first series of slats 100 mounted on an endless flexible member such as chain 102 backed by a rigid bar 104, and which cooperates with a second series of slats 106 mounted on an endless chain 108 backed by a bar 110.

The feed mechanism is carried by a support 112 mounted on the head 14 of the tufting machine and includes a driven sprocket 114 and a pair of idler sprockets 116 about which the chain 102 is trained. The chain 104 is trained about a similar drive sprocket 118 and idlers 120. The sprockets 114 and 118 may be driven by chains (not shown) from the main drive of the machine. Each of the slats 100 is provided with a continuous repeating arrangement of shallow notches 122 extending from the outer end of the slats. Two such adjacent notches are provided for each needle or yarn end in the machine. The slats 106 are each provided with a repeating arrangement of a shallow notch 124, a deep notch 126, a notch 128 of depth intermediate that of the notches 124 and 126, and a deep notch 126. Each pair of notches 124, 126 corresponds to each needle 32 and each pair of notches 128, 126 corresponds to each needle 33. In the working zone between bars 104 and 110 the slats 100 intermesh with the slats 102, i.e. slats 100 are between slats 102, and are driven in synchronism. Thus, each two notches 124, 126 of the slats 106 have a corresponding pair of notches 122 in the slats 100, as do each pair of notches 128, 126.

Yarn Y from the source is directed for each needle to the selected notch in the slats 106 by a shiftable yarn guide 130 which places the yarn in the corresponding notch 122 of the slats 100. When yarn for a needle 32 is directed by the guide 130 in a notch 122 corresponding to notch 124 a greater amount of yarn is fed than when directed into a notch 122 corresponding to notch 126. Similarly with yarn fed to the needles 33. It should be understood that the deeper the notch that yarn is directed to in the slats 106, the smaller the amount of yarn that is fed to the corresponding needle. The notches are cut so that notches 126 correspond to the amount of yarn required to force the clip 90 from the hook bill to form uncut loop pile. The notches 124 and 128 correspond to the yarn required to form cut pile with the respective needles 32, 33.

The means for shifting the yarn guide 130 comprises a housing 132 mounted on the head 14 of the machine and having a plurality of pivot rods 134, each carrying one guide 130. Each rod 134 has an arm 136 extending into the housing 132 and is connected to the armature of a solenoid 138 selectively energized to move the guide 130 toward one of the two notches 122. When de-energized the guide returns to its normal position by a spring (not illustrated). For a fuller disclosure of the feed mechanism reference may be had to U.S. Pat. No. 3,207,105 which discloses the mechanism in greater detail, not considered necessary for the present purposes.

The solenoids 138 may be energized or deenergized by a pattern control of any conventional form. One such preferred arrangement is a transparent pattern drum 140 carrying a pattern sheet 142 with an opaque pattern painted thereon and mounted in a console 144. This pattern reading and signaling device is well known and disclosed in U.S. Pat. Nos. 3,922,979 and 3,272,163 to which reference may be had for a complete description. Photocells within the console sense the light and dark areas of the pattern and transmit their outputs to switching units within the console, the outputs of which are transmitted by wires within a conduit 146 to the solenoids 138. Another pattern control which can be used to control the solenoids is illustrated in the aforesaid U.S. Pat. No. 3,207,105.

Figure 6:
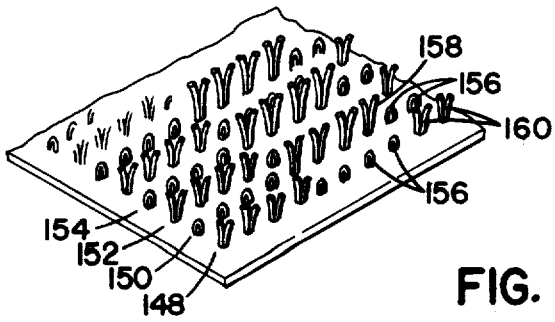
FIG. 6 is a fragmentary perspective view of one form of the tufted fabric product of the invention.

In FIG. 6, there is illustrated typically a carpet fabric that can be produced by the teachings herein. The rows 148 and 152 are produced by needles 33 and the rows 150 and 154 are produced by needles 32. Row 150 illustrates the short uncut loop 156 and the long cut pile 158, while row 148 illustrates the short uncut loops 156 and cut pile 160 of length intermediate the loops 156 and the cut pile 158. Any desired combination of the two heights for each needle can be selected with differing combinations in adjacent rows to obtain various arrays of pattern fabrics.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. In a tufting machine, means for feeding a backing fabric in one direction, first and second yarn-carrying needles disposed on one side of said backing fabric, means for reciprocating said first needle for penetrating the backing fabric to a first level to form a first row of loops therein and for reciprocating said second needle to a second and deeper level to form a second row of longer loops therein, means for supporting a first hook on the other side of the backing fabric having a free end pointing opposite said one direction for entering the loops of the first row in succession, means for supporting a second hook further from the backing fabric on the other side of the backing fabric having a free end pointing opposite said one direction for entering the loops of the second row in succession, yieldable clip means for engaging the free end of each hook normally to prevent the withdrawal of loops therefrom, means for backdrawing yarn selectively from each hook to pull a selective loop with substantially the same sufficient tension to cause said selective loop to force the yieldable means away from said free end and withdraw from the hook, and means for severing the loops remaining on each hook.

2. In a tufting machine as recited in claim 2 wherein said means for supporting said hooks comprises a hook bar mounted for oscillation relatively to said needles, each of said hooks comprising a body portion having a blade, a shank and a planar mounting portion, said blade extending from the upper part of the shank and terminating at the free end, said mounting portion extending from the lower part of the shank and facing oppositely from the blade, said first and second hooks being substantially identical, and said hook bar having a first slot for receiving the mounting portion of the first hook and a second slot for receiving the mounting portion of the second hook, said first slot being disposed closer to said backing fabric than said second slot.

3. In tufting machine as recited in claim 1 wherein said means for supporting said hooks comprises a hook bar mounted for oscillation relatively to said needles, each of said hooks comprising a body portion having a blade, a shank and a planar mounting portion, said blade extending from the upper part of the shank and terminating at the free end, said mounting portion extending from the lower part of the shank and facing oppositely from the blade, the blade of said first hook being disposed further from the corresponding mounting portion than that blade of the second hook is disposed from its corresponding mounting portion, and said hook bar having first and second slots for receiving the respective mounting portions of said first and second hooks, said first and second slots being disposed substantially equally from said backing fabric.

4. In a tufting machine, means for feeding a backing fabric in one direction, first and second yarn carrying needles for penetrating the fabric and forming respective first and second loops therein, means for reciprocating said needles for penetrating said second needle deeper through said backing fabric then said first needle so said second loops are longer than said first loops, first and second oscillatory hooks for entering the first and second loops respectively in succession and facing in a direction opposite to the direction of feed of the fabric, said second hook being further from said fabric then said first hook, means for oscillating said hooks, a knife cooperating with each hook for severing loops thereon, a spring clip fixed to each hook, said clip having a free end biased against the respective hook near its free end for normally maintaining loops on said hook and for permitting escape of said loops from said hook when a predetermined yarn tension is exerted on said yarn, and means for feeding to each needle upon each stitch predetermined lengths of yarn that are selectively adequate or inadequate to accomodate the yarn requirements of the respective needle and hook system, said inadequate length of yarn being the same for each hook, whereby when an adequate length of yarn is fed the loops will remain on said hooks and be severed by the respective knife and when an inadequate length of yarn is fed the loop will be backdrawn from said hooks to substantially the same level.

5. In a tufting machine as recited in claim 4 wherein said means for reciprocating said needles includes a needle bar supporting said needles, said second needle extending from said needle bar further than said first needle.

6. In a tufting machine as recited in claim 5 wherein said means for oscillating said hooks includes a hook bar, each of said hooks comprising a body portion having a blade, a shank and a planar mounting portion, said blade extending from the upper part of the shank and terminating at a free end, said mounting portion extending from the lower part of the shank and facing oppositely from the blade, said first and second hooks being substantially identical, and said hook bar having a first slot for receiving the mounting portion of the first hook and a second slot for receiving the mounting portion of the second hook, said first slot being disposed closer to said backing fabric than said second slot.

7. In a tufting machine as recited in claim 5 wherein said means for oscillating said hooks includes a hook bar, each of said hooks comprising a body portion having a blade, a shank and a planar mounting portion, said blade extending from the upper part of the shank and terminating at a free end, said mounting portion extending from the lower part of the shank and facing oppositely from the blade, the blade of said first hook being disposed further from the corresponding mounting portion than that blade of the second hook is disposed from its corresponding mounting portion, and said hook bar having first and second slots for receiving the respective mounting portions of said first and second hooks, said first and second slots being disposed substantially equally from said backing fabric.

* * * * *